US012351885B2

(12) United States Patent
Lim et al.

(10) Patent No.: US 12,351,885 B2
(45) Date of Patent: Jul. 8, 2025

(54) WIRE ROD FOR GRAPHITIZATION HEAT TREATMENT, GRAPHITE STEEL, AND MANUFACTURING METHOD THEREFOR

(71) Applicant: POSCO, Pohang-si (KR)

(72) Inventors: Nam-Suk Lim, Pohang-si (KR); In-Gyu Park, Pohang-si (KR); Se Hong Min, Pohang-si (KR); Seon-Gu Lee, Cheongju-si (KR)

(73) Assignee: POSCO CO., LTD, Pohang-si (KR)

( * ) Notice: Subject to any disclaimer, the term of this patent is extended or adjusted under 35 U.S.C. 154(b) by 657 days.

(21) Appl. No.: 17/617,189

(22) PCT Filed: Jan. 22, 2020

(86) PCT No.: PCT/KR2020/001133
§ 371 (c)(1),
(2) Date: Dec. 7, 2021

(87) PCT Pub. No.: WO2021/149849
PCT Pub. Date: Jul. 29, 2021

(65) Prior Publication Data
US 2022/0235441 A1 Jul. 28, 2022

(51) Int. Cl.

| | |
|---|---|
| ***C21D 8/06*** | (2006.01) |
| ***B21C 1/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |

(52) U.S. Cl.
CPC ..... *C21D 8/06* (2013.01); *B21C 1/02* (2013.01); *C22C 38/001* (2013.01); *C22C 38/002* (2013.01); *C22C 38/02* (2013.01); *C22C 38/04* (2013.01); *C22C 38/06* (2013.01); *C22C 38/14* (2013.01)

(58) Field of Classification Search
CPC ..... B21C 1/003; B21C 1/02; B21C 37/045; C21D 1/26; C21D 2211/004; C21D 2211/005; C21D 2211/006; C21D 2211/009; C21D 6/008; C21D 8/06; C21D 8/065; C21D 9/525; C22C 38/001; C22C 38/002; C22C 38/02; C22C 38/04; C22C 38/06; C22C 38/14
See application file for complete search history.

(56) References Cited

U.S. PATENT DOCUMENTS 6,419,761 B1 7/2002 Hashimura et al.
7,789,974 B2 * 9/2010 Hashimura ..... C22C 38/22 148/333
2003/0201036 A1 * 10/2003 Hashimura ..... B32B 17/10788 148/333

FOREIGN PATENT DOCUMENTS

| | | | |
|---|---|---|---|
| CN | 105671441 | A | 6/2016 |
| CN | 106191710 | A | 12/2016 |
| CN | 109863255 | A | 6/2019 |
| CN | 109943772 | A | 6/2019 |
| CN | 110100027 | A | 8/2019 |
| JP | H07-188850 | A | 7/1995 |
| JP | 10-72639 | A | 3/1998 |
| JP | H11-131187 | A | 5/1999 |
| JP | H11-229074 | A | 8/1999 |
| JP | H11-350067 | A | 12/1999 |
| JP | 2002-080937 | A | 3/2002 |
| JP | 2003-105485 | A | 4/2003 |
| JP | 2007-327084 | A | 12/2007 |
| JP | 2019-112711 | A | 7/2019 |
| KR | 10-0605722 | B1 | 8/2006 |
| KR | 10-0605723 | B1 | 8/2006 |
| KR | 10-2019-0075512 | A | 7/2019 |

OTHER PUBLICATIONS

NPL: on-line translation of JP 11350067 A, , 12, 1999 (Year: 1999).*
Japanese Office Action dated Aug. 8, 2023 issued in Japanese Patent Application No. 2021-575471 (with English translation).
Japanese Office Action dated Jan. 16, 2023, issued in corresponding Japanese Patent Application No. 2021-575471.
European Extended Search Report dated Aug. 2, 2022 issued in European Patent Application No. 20915128.1.
European Communication dated Aug. 22, 2022 issued in European Patent Application No. 20915128.1.
International Search Report and Written Opinion dated Oct. 13, 2020 issued in International Patent Application No. PCT/KR2020/001133 (with English translation).
(Continued)

*Primary Examiner* — Jie Yang
(74) *Attorney, Agent, or Firm* — Morgan Lewis & Bockius LLP

(57) ABSTRACT

A graphite steel available as a material for mechanical parts of industrial machines or automobiles, and more particularly, a steel wire for graphitization heat treatment and a graphite steel and methods of manufacturing the same. The graphite steel includes, in percent by weight (wt %), 0.6 to 0.9% of carbon (C), 2.0 to 2.5% of silicon (Si), 0.1 to 0.6% of manganese (Mn), 0.015% or less of phosphorus (P), 0.03% or less of sulfur (S), 0.01 to 0.05% of aluminum (Al), 0.01 to 0.02% of titanium (Ti), 0.0005 to 0.002% of boron (B), 0.003 to 0.015% of nitrogen (N), 0.005% or less of oxygen (O), and the remainder of iron (Fe) and inevitable impurities, and satisfying Equation (1) below: wherein graphite grains are distributed in a ferrite base as a microstructure and a graphitization rate is 100%, (1) $-0.003<[N]-[Ti]/3.43-[B]/0.77<0.003$, wherein in Equation (1), [Ti], [N], and [B] are wt % of titanium, nitrogen, and boron, respectively.

7 Claims, No Drawings

(56) References Cited

OTHER PUBLICATIONS

Korean Notice of Allowance dated Dec. 3, 2020 issued in Korean Patent Application No. 10-2018-0164549.
Korean Office Action dated Jul. 3, 2020 issued in Korean Patent Application No. 10-2018-0164549.
Chinese Office Action dated Apr. 2, 2022 issued in Chinese Patent Application No. 202080046316.89 (with English translation).

* cited by examiner

WIRE ROD FOR GRAPHITIZATION HEAT TREATMENT, GRAPHITE STEEL, AND MANUFACTURING METHOD THEREFOR

CROSS-REFERENCE OF RELATED APPLICATIONS

This application is the U.S. National Phase under 35 U.S.C. § 371 of International Patent Application No. PCT/KR2020/001133, filed on Jan. 22, 2020, the entire disclosure of which is incorporated by reference herein.

TECHNICAL FIELD

The present disclosure relates to a graphite steel available as a material for mechanical parts of industrial machines or automobiles, and more particularly, a steel wire for graphitization heat treatment and a graphite steel and methods of manufacturing the same.

BACKGROUND ART

In general, as materials of mechanical parts required to have machinability, free cutting steels prepared by adding a machinability-providing element such as Pb, Bi, and S thereto are used. Harmful substances such as toxic fumes are discharged during a process of cutting a Pb-added free cutting steel, which is the most representative free cutting steel, and these substances are very harmful to human body and cause problems adversely affecting recycling of steel materials.

In order to replace Pb-added free cutting steels due to such problems, addition of S, Bi, Te, Sn, or the like has been proposed, but it is very difficult to produce Bi-added steels since cracks easily occur during a manufacturing process, and S, Te, and Sn may cause cracks during hot rolling.

Graphite steels have been proposed to solve such problems. However, although graphite is a stable phase, graphite is precipitated as cementite that is a metastable phase in a graphite steel prepared by adding carbon to a steel and thus it is difficult to precipitate graphite without additional heat treatment for a long time of several dozens of hours. During such a long heat treatment process, decarbonization occurs, to adversely affect performance of final products.

In addition, although graphite grains are precipitated by graphitization heat treatment, the possibility of occurrence of cracks may increase when coarse graphite grains are precipitated in a base material of a steel. Also, when the graphite grains, in a non-uniform shape not in a spherical shape, are distributed non-uniformly, physical properties are non-uniformly distributed, and thus chip processability and surface roughness deteriorate during cutting and lifespans of tools are shortened, making it difficult to obtain advantages of the graphite steel.

DISCLOSURE

Technical Problem

The present disclosure has been proposed to solve the above problems and an object of the present disclosure is to provide a steel wire for graphitization heat treatment and a graphite steel capable of significantly reducing a graphitization heat treatment time and uniformly distributing fine graphite grains in a base material during heat treatment and methods of manufacturing the same.

Technical Solution

One aspect of the present disclosure provides a steel wire for graphitization heat treatment including, in percent by weight (wt %), 0.6 to 0.9% of carbon (C), 2.0 to 2.5% of silicon (Si), 0.1 to 0.6% of manganese (Mn), 0.015% or less of phosphorus (P), 0.03% or less of sulfur (S), 0.01 to 0.05% of aluminum (Al), 0.01 to 0.02% of titanium (Ti), 0.0005 to 0.002% of boron (B), 0.003 to 0.015% of nitrogen (N), 0.005% or less of oxygen (O), and the remainder of iron (Fe) and inevitable impurities, and satisfying Equation (1) below:

$$-0.003<[N]-[Ti]/3.43-[B]/0.77<0.003 \quad (1)$$

wherein in Equation (1), [Ti], [N], and [B] are wt % of titanium, nitrogen, and boron, respectively.

In addition, the number of TiN having a size of 100 nm or less may be 10 or more per 100 $\mu m^2$.

In addition, an area fraction of pearlite may be 95% or more.

In addition, a tensile strength may be 1100 MPa or less.

Another aspect of the present disclosure provides a method of manufacturing a steel wire for graphitization heat treatment including: preparing a billet including, in percent by weight (wt %), 0.6 to 0.9% of carbon (C), 2.0 to 2.5% of silicon (Si), 0.1 to 0.6% of manganese (Mn), 0.015% or less of phosphorus (P), 0.03% or less of sulfur (S), 0.01 to 0.05% of aluminum (Al), 0.01 to 0.02% of titanium (Ti), 0.0005 to 0.002% of boron (B), 0.003 to 0.015% of nitrogen (N), 0.005% or less of oxygen (O), and the remainder of iron (Fe) and inevitable impurities, and satisfying Equation (1) below; reheating the billet; hot rolling the reheated billet into a steel wire; coiling the steel wire; and cooling the coiled steel wire:

$$-0.003<[N]-[Ti]/3.43-[B]/0.77<0.003 \quad (1)$$

wherein in Equation (1), [Ti], [N], and [B] are wt % of titanium, nitrogen, and boron, respectively.

In addition, the reheating may include heat-treating the billet in a temperature range of 1050 to 1150° C. for 60 minutes or more.

In addition, the hot rolling of the reheated billet into a steel wire may include hot rolling the reheated billet in a temperature range of 900° C. to 1000° C.

In addition, the coiling may include coiling the steel wire in a temperature range over 800° C.

In addition, the cooling may include cooling the coiled steel wire to 600° C. at a cooling rate of 0.2 to 5.0° C./s.

Another aspect of the present disclosure provides a graphite steel including, in percent by weight (wt %), 0.6 to 0.9% of carbon (C), 2.0 to 2.5% of silicon (Si), 0.1 to 0.6% of manganese (Mn), 0.015% or less of phosphorus (P), 0.03% or less of sulfur (S), 0.01 to 0.05% of aluminum (Al), 0.01 to 0.02% of titanium (Ti), 0.0005 to 0.002% of boron (B), 0.003 to 0.015% of nitrogen (N), 0.005% or less of oxygen (O), and the remainder of iron (Fe) and inevitable impurities, and satisfying Equation (1) below: wherein graphite grains are distributed in a ferrite base material as a microstructure and a graphitization rate is 100%, $$-0.003<[N]-[Ti]/3.43-[B]/0.77<0.003 \quad (1)$$

wherein in Equation (1), [Ti], [N], and [B] are wt % of titanium, nitrogen, and boron, respectively.

In addition, an average grain size of the graphite grains may be 10 μm or less.

In addition, an aspect ratio (long/short) of the graphite grains may be 2.0 or less.

In addition, the graphite grains may be distributed in an area fraction of 2.0% or more.

In addition, the graphite grains may be distributed at a density of 1000 grains/mm$^2$ or more.

In addition, a hardness may be from 70 to 85 HRB.

Another aspect of the present disclosure provides a method of manufacturing a graphite steel including: preparing a steel wire including, in percent by weight (wt %), 0.6 to 0.9% of carbon (C), 2.0 to 2.5% of silicon (Si), 0.1 to 0.6% of manganese (Mn), 0.015% or less of phosphorus (P), 0.03% or less of sulfur (S), 0.01 to 0.05% of aluminum (Al), 0.01 to 0.02% of titanium (Ti), 0.0005 to 0.002% of boron (B), 0.003 to 0.015% of nitrogen (N), 0.005% or less of oxygen (O), and the remainder of iron (Fe) and inevitable impurities, and satisfying Equation (1) below; cold drawing the prepared steel wire; and performing graphitization heat treatment, $$-0.003<[N]-[Ti]/3.43-[B]/0.77<0.003 \quad (1)$$

wherein in Equation (1), [Ti], [N], and [B] are wt % of titanium, nitrogen, and boron, respectively.

In addition, the cold drawing may include cold drawing the prepared steel wire with a reduction rate of 10 to 20%.

In addition, the performing of graphitization heat treatment may include heat treatment in a temperature range of 740 to 780° C. within 2 hours.

Advantageous Effects

According to the present disclosure, a graphitization heat treatment time may be significantly reduced by promoting graphitization using the alloy composition for promoting graphitization and utilizing TiN acting as nuclei for forming graphite grains, and further promoting graphitization by inducing lattice defects via cold drawing with an appropriate reduction rate.

In addition, the present disclosure provides a graphite steel in which fine graphite grains are uniformly distributed in a base material after graphitization.

MODES OF THE INVENTION

Hereinafter, embodiments of the present disclosure will be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the concept of the invention to those skilled in the art.

The terms used in the present specification are merely used to describe particular embodiments, and are not intended to limit the present disclosure. An expression used in the singular encompasses the expression of the plural unless it has a clearly different meaning in the context. In the present specification, it is to be understood that the terms such as "comprise" or "include" are intended to indicate the existence of the features, operations, functions, components, or combinations thereof disclosed in the specification, and are not intended to preclude the possibility that one or more other features, operations, functions, components, or combinations thereof may exist or may be added.

The terms used in the present specification have the meaning commonly understood by one of ordinary skill in the art to which the present specification belongs. Terms commonly used should be interpreted in a consistent sense in the context of the present specification. Further, terms used in the present specification should not be interpreted in an idealistic or formal sense unless the meaning is clearly defined. An expression used in the singular encompasses the expression of the plural unless it has a clearly different meaning in the context.

Words of degree, such as "about," "substantially," and the like are used herein in the sense of "at, or nearly at, when given the manufacturing, design, and material tolerances inherent in the stated circumstances" and are used to prevent the unscrupulous infringer from unfairly taking advantage of the invention disclosure where exact or absolute figures and operational or structural relationships are stated as an aid to understanding the invention.

Although graphite is a stable phase, graphite is precipitated as cementite that is a metastable phase in a graphite steel prepared by adding carbon to a steel and thus it is difficult to precipitate graphite without additional heat treatment for a long time of several dozens of hours. During such a long heat treatment process, decarbonization occurs, to adversely affect performance of final products.

In addition, although graphite grains are precipitated by graphitization heat treatment, the possibility of occurrence of cracks may increase when coarse graphite grains are precipitated in a base material of a steel. Also, when the graphite grains, in a non-uniform shape not in a spherical shape, are distributed non-uniformly, physical properties re non-uniformly distributed, and thus chip processability and surface roughness deteriorate during cutting and lifespans of tools are shortened, making it difficult to obtain advantages of the graphite steel.

To solve the above-described problems, the present disclosure provides a steel wire for graphitization heat treatment and a graphite steel in which fine graphite grains are uniformly distributed in a base material during heat treatment with a significantly reduced graphitization heat treatment time and methods of manufacturing the same.

According to an aspect of the present disclosure, a steel wire for graphitization heat treatment includes, in percent by weight (wt %), 0.6 to 0.9% of carbon (C), 2.0 to 2.5% of silicon (Si), 0.1 to 0.6% of manganese (Mn), 0.015% or less of phosphorus (P), 0.03% or less of sulfur (S), 0.01 to 0.05% of aluminum (Al), 0.01 to 0.02% of titanium (Ti), 0.0005 to 0.002% of boron (B), 0.003 to 0.015% of nitrogen (N), 0.005% or less of oxygen (O), and the remainder of iron (Fe) and inevitable impurities.

Meanwhile, because the steel wire for graphitization heat treatment is used to prepare a graphite steel having the same alloy composition as that of the steel wire, descriptions for the reasons of limiting the alloy composition of the graphite steel are omitted without limiting herein, but it can be interpreted in the same manner as the reasons for limiting the alloy composition of the steel wire for graphitization heat treatment within the ranges clearly understood by those skilled in the art.

Hereinafter, the reasons of limiting the alloy composition will be described in detail. All of the components listed below indicate wt % unless otherwise specified.

Carbon (C): 0.6 to 0.9 wt %

Carbon is an element essential for forming graphite grains. When the C content is less than 0.6 wt %, machinability-improving effects are not sufficient and graphite grains are non-uniformly distributed even after graphitization is completed.

On the contrary, when the C content is excessive over 0.9 wt %, coarse graphite grains are formed and an aspect ratio increases, and thus machinability, particularly, surface roughness may deteriorate. Therefore, it is preferable to control the C content from 0.6 to 0.9 wt % in the present disclosure.

Silicon (Si): 2.0 to 2.5 wt %

Silicon is a component required in the manufacture of molten steels as a deoxidizer and added as a graphitization-promoting element because silicon destabilizes cementite contained in steels to precipitate carbon into graphite. The Si content is preferably controlled to be 2.0 wt % or more to obtain such effects in the present disclosure.

However, when the Si content is excessive over 2.5 wt %, graphitization-promoting effects are saturated and hardness increases due to solid solution strengthening effects, and thus abrasion of tools is accelerated during cutting, embrittlement is induced in accordance with an increase in non-metallic inclusions, and excessive decarbonization may be induced during hot rolling. Therefore, it is preferable to control the Si content from 2.0 to 2.5 wt % in the present disclosure.

Manganese (Mn): 0.1 to 0.6 wt %

Manganese improves strength and impact properties of steel materials and binds to sulfur contained in the steels to form MnS inclusions, contributing to improvement of machinability. The Mn content is preferably controlled to be 0.1 wt % or more to obtain such effects in the present disclosure.

On the contrary, when the Mn content is excessive over 0.6 wt %, graphitization may be inhibited to delay a graphitization completion time and strength and hardness may increase to deteriorate machinability. Therefore, it is preferable to control the Mn content from 0.1 to 0.6 wt % in the present disclosure.

Phosphorus (P): 0.015 wt % or Less

Phosphorus is an impurity inevitably contained in steels. Although machinability may be increased to some extent by weakening grain boundaries of steels, phosphorus increases hardness of ferrite due to considerable solid solution strengthening effects, reduces toughness and delayed fracture resistance of steel materials, causes surface defects, and thus it is preferable to control the P content to be as low as possible.

Although it is advantageous to control the P content to 0 wt % in theory, P is inevitably contained during a manufacturing process. Therefore, it is important to control an upper limit of the P content, and thus the upper limit of the P content is controlled to 0.015 wt % in the present disclosure.

Sulfur (S): 0.03 wt % or Less

Although sulfur contributes to improve machinability by forming MnS inclusions, it considerably inhibits graphitization of carbon in steels, is segregated in grain boundaries to reduce toughness, inhibits hot rollability by forming low-melting point sulfides, and induces mechanical anisotropy due to MnS stretched by rolling. Thus, it is preferable to control the S content to be as low as possible.

Although it is advantageous to control the S content to 0 wt % in theory, S is inevitably contained during a manufacturing process. Therefore, it is important to control an upper limit of the S content, and thus the upper limit of the S content is controlled to 0.03 wt % in the present disclosure.

Aluminum (Al): 0.01 to 0.05 wt %

Aluminum is an element promoting graphitization together with silicon. This is because aluminum destabilizes cementite when present as a solid solution, and aluminum needs to be present as a solid solution. The Al content is preferably controlled to 0.01 wt % or more to obtain such effects in the present disclosure.

On the contrary, when the Al content is excessive over 0.05 wt %, effects thereof are saturated, a nozzle may be blocked during a casting process, and AlN is generated in austenite grain boundaries resulting in non-uniform distribution of graphite grains formed using AlN as nuclei in the grain boundaries. Therefore, it is preferable to control the Al content from 0.01 to 0.05 wt % in the present disclosure.

Titanium (Ti): 0.01 to 0.02 wt %

Titanium, like boron, aluminum, and the like, binds to nitrogen and a nitride such as TiN, BN, and AlN is formed. The nitrides act as nuclei for formation of graphite grains during constant temperature heat treatment. BN, AlN, and the like are precipitated non-uniformly in the grain boundaries after austenite is formed due to low formation temperatures thereof. On the contrary, TiN is crystalized before formation of austenite is completed since a formation temperature thereof is higher than those of AlN and BN, and thus TiN is uniformly distributed in grain boundaries and inside grains of austenite. Thus, graphite grains generated using TiN as nuclei also finely and uniformly distributed. To obtain such effects, the Ti content is preferably controlled to 0.01 wt % or more.

On the contrary, when the Ti content is excessive over 0.02 wt %, carbon required for graphite formation is consumed due to formation of a coarse carbonitride, and thus graphitization may be inhibited. Thus, it is preferable to control the Ti content from 0.01 to 0.02 wt % in the present disclosure.

Boron (B): 0.0005 to 0.002%

Boron binds to nitrogen contained in steels to form BN. BN promotes graphitization by acting as nuclei for formation of graphite grains. The B content is preferably controlled to 0.0005 wt % or more to obtain such effects.

On the contrary, when the B content is excessive over 0.002 wt %, the BN content is excessive in gran boundaries of austenite causing non-uniform distribution of graphite grains after graphitization heat treatment and also the grain boundaries are weakened to considerably reducing hot rollability. Thus, it is preferable to control the B content from 0.0005 to 0.002 wt % in the present disclosure.

Nitrogen (N): 0.003~0.015 wt %

Nitrogen binds to titanium, boron, or aluminum to form TiN, BN, AlN, or the like. Particularly, a nitride such as BN and AlN is mainly formed in grain boundaries of austenite. Graphite grains are uniformly distributed by using such a nitride as nuclei during graphitization heat treatment. To this end, the N content is 0.003 wt % or more in the present disclosure.

However, when the N content is excessive over 0.015 wt %, a nitride is excessively formed so that graphite grains may be non-uniformly distributed. Or, nitrogen cannot bind to a nitride-forming element but is present in a solid solution state in the steel to increase strength and stabilizing cementite, thereby delaying graphitization. Therefore, it is preferable to control the N content from 0.003 to 0.015 wt % in the present disclosure.

Oxygen (O): 0.005 wt % or Less

In the present disclosure, oxygen plays an important role. Oxygen binds to aluminum to form an oxide. Formation of such an oxide reduces an effective concentration of solid-solution aluminum resulting in inhibiting graphitization. In addition, an alumina oxide formed by containing a large amount of oxygen damages cutting tools during cutting, thereby causing deterioration in machinability. Due to these reasons, it is preferable to control the O content to be as low as possible. However, when the O content is controlled too low, refining loads are caused in a steelmaking process, and thus it is preferable to control an upper limit to be 0.005 wt % or less.

A remaining component of the present disclosure is iron (Fe). However, in the general manufacturing process, impurities that are not intended from a raw material or a surrounding environment can be inevitably mixed, and therefore cannot be excluded. Since these impurities can be known to anyone skilled in the ordinary manufacturing process, they are not specifically mentioned in the present specification.

According to an embodiment of the present disclosure, the alloy components may satisfy Equation (1) below.

$$-0.003<[N]-[Ti]/3.43-[B]/0.77<0.003 \quad (1)$$

In Equation (1), [Ti], [N], and [B] are wt % of titanium, nitrogen, and boron, respectively.

Equation (1) is a relational expression for inducing formation of fine graphite grains and significantly reducing a time required for graphitization, and reasons for limitation to the above range are as follows.

When a value of Equation (1) is −0.003 or less, coarse TiN or BN, which is formed by Ti or B excessively remaining in steels, cannot act as suitable nuclei for formation of graphite grains and fine graphite grains and uniform distribution thereof cannot be expected. On the contrary, when the value of Equation (1) is 0.003 or more, the content of *soli*-solution N increases in steels to considerably delay graphitization. Therefore, it is preferable to control the value of Equation (1) to be greater than −0.003 and less than 0.003 in the present disclosure.

In the steel wire for graphitization heat treatment having the above-described alloy composition range and satisfying Equation (1) according to the present disclosure, the number of TiN having a size of 100 nm or less may be 10 or more per 100 $\mu m^2$. In the present disclosure, because TiN acts as main nuclei for formation of graphite grains during the graphitization heat treatment process, distribution of fine TiN at a high density is advantageous to obtain uniform and fine graphite grains, and thus an upper limit thereof is not particularly limited.

In addition, in the steel wire for graphitization heat treatment, an area fraction of pearlite may be 95% or more. In the present disclosure, because graphite grains are generated by decomposition of pearlite, a lower fraction of pearlite inevitably leads to a lower fraction of graphite grains resulting in non-uniform distribution thereof. A high area fraction of pearlite is advantageous for obtaining uniform and fine graphite grains, and thus an upper limit thereof is not particularly limited.

In addition, a tensile strength of the steel wire for graphitization heat treatment may be 1100 MPa or less. In the present disclosure, it is preferable that a strength of the steel wire does not exceed 1100 MPa for cold drawing that induces lattice defects for additionally promoting graphitization, and thus a lower limit thereof is not particularly limited.

Hereinafter, a method of manufacturing a steel wire for graphitization heat treatment will be described first, and then a method of manufacturing a graphite steel will be described in detail.

A method of manufacturing a steel wire for graphitization heat treatment according to an embodiment includes: preparing a billet including, in percent by weight (wt %), 0.6 to 0.9% of carbon (C), 2.0 to 2.5% of silicon (Si), 0.1 to 0.6% of manganese (Mn), 0.015% or less of phosphorus (P), 0.03% or less of sulfur (S), 0.01 to 0.05% of aluminum (Al), 0.01 to 0.02% of titanium (Ti), 0.0005 to 0.002% of boron (B), 0.003 to 0.015% of nitrogen (N), 0.005% or less of oxygen (O), and the remainder of iron (Fe) and inevitable impurities, and satisfying Equation (1): reheating the billet; hot rolling the reheated billet into a steel wire; coiling the steel wire; and cooling the coiled steel wire.

Hereinafter, each step of the method of manufacturing a steel wire for graphitization heat treatment of the present disclosure will be described.

Reheating Step

According to an embodiment of the present disclosure, the reheating step may be performed by heat-treating the billet in a temperature range of 1050 to 1150° C. for 60 minutes or more before hot rolling the billet.

When the heating temperature of the billet is lower than 1050° C., coarse TiN is precipitated to decrease the density thereof and Al is precipitated into AlN to decrease an amount of solid-solution Al that promotes graphitization. In addition, when the heating temperature of the billet exceeds 1150° C., not only manufacturing costs increase but also the quality of final products may deteriorate since decarbonization is accelerated to increase the thickness of a decarburized layer. Therefore, it is preferable to control the reheating temperature range from 1050 to 1150° C. in the present disclosure.

When the heat treatment time is less than 60 minutes, it is difficult to uniformly control internal and external temperatures of the billet for hot rolling, and thus it is preferable to control the heat treatment time to be 60 minutes or more in the present disclosure.

Hot Rolling Reheated Billet into Steel Wire

According to an embodiment of the present disclosure, the step of hot rolling the reheated billet into a steel wire may be performed by hot rolling the reheated billet in a temperature range higher than 900° C. and 1000° C. or lower to prepare a steel wire.

When the hot rolling temperature is lower than 900° C., the possibility of surface defects increases during hot rolling. When the hot rolling temperature exceeds 1000° C., austenite grain size (AGS) increases, wire breakage may occur during cold drawing after rolling the steel wire. Therefore, it is preferable to control the hot rolling temperature range to be higher than 900° C. and 1000° C. or less in the present disclosure.

It is preferable to control a diameter of the steel wire prepared by hot rolling to be 30 mm or less. This is because a decarburized layer becomes thicker as a wire diameter increases since a decarburized area of the billet extracted from a heating furnace is in proportion to a decarburized area the steel wire after hot rolling.

Coiling Steel Wire

According to an embodiment of the present disclosure, the coiling of the steel wire may be performed in a temperature range over 800° C.

When the coiling temperature is lower than 800° C., stiffness of the steel wire increases during coiling to increase the possibility of surface defects and it is difficult to obtain a perfect coiled shape. Therefore, it is preferable to control the coiling temperature range to be over 800° C. in the present disclosure.

Cooling Coiled Steel Wire

According to an embodiment of the present disclosure, the coiled steel wire may be cooled to 600° C. at a cooling rate of 0.2 to 5.0° C./s.

When the cooling rate is greater than 5.0° C./s, a hard phase, such as martensite, generated from supercooled austenite may cause occurrence of wire breakage during cold drawing. When the cooling rate is less than 0.2° C./s, a proeutectoid phase is excessively formed and thus a fraction of pearlite decreases resulting in non-uniform distribution of graphite grains formed after graphitization heat treatment.

Therefore, it is preferable to control the cooling rate from 0.2 to 5.0° C./s in the present disclosure.

In the steel wire for graphitization heat treatment of the present disclosure prepared according to the above-described manufacturing process, the number of TiN having a size of 100 nm or less may be 10 or more per 100 $\mu m^2$.

In the present disclosure, because TiN acts as main nuclei for formation of graphite grains during the graphitization heat treatment process, distribution of fine TiN at a high density is advantageous to obtain uniform and fine graphite grains, and thus an upper limit thereof is not particularly limited.

In addition, the area fraction of pearlite of the prepared steel wire for graphitization heat treatment may be 95% or more.

In addition, the tensile strength of the prepared steel wire for graphitization heat treatment may be 1100 MPa or less. In the present disclosure, it is preferable that the strength of the steel wire does not exceed 1100 MPa for cold drawing that induces lattice defects for additionally promoting graphitization, and thus a lower limit thereof is not particularly limited.

Hereinafter, a method of manufacturing a graphite steel according to the present disclosure will be described.

A method of manufacturing a graphite steel according to an embodiment includes: preparing a billet including, in percent by weight (wt %), 0.6 to 0.9% of carbon (C), 2.0 to 2.5% of silicon (Si), 0.1 to 0.6% of manganese (Mn), 0.015% or less of phosphorus (P), 0.03% or less of sulfur (S), 0.01 to 0.05% of aluminum (Al), 0.01 to 0.02% of titanium (Ti), 0.0005 to 0.002% of boron (B), 0.003 to 0.015% of nitrogen (N), 0.005% or less of oxygen (O), and the remainder of iron (Fe) and inevitable impurities, and satisfying Equation (1); reheating the billet; hot rolling the reheated billet into a steel wire; coiling the steel wire; cooling the coiled steel wire; cold drawing the cooled steel wire; and performing graphitization heat treatment.

In this regard, the preparing the billet, reheating the billet, hot rolling the billet into a steel wire, and coiling and coiling the steel wire are the same as those described above in the method of manufacturing the steel wire for graphitization heat treatment, and thus descriptions thereof will be omitted to avoid repetition. The cold drawing of the steel wire prepared by the manufacturing method as described above and graphitization heat treatment will be described, respectively.

Cold Drawing Cooled Steel Wire

In the present disclosure, the step of cold drawing the cooled steel wire is an important step for generating additional nuclei for formation of graphite grains such as fine TiN at a high density. In the step, the additional nuclei for formation of graphite grains may be formed by inducing lattice defects in the steel wire by cold drawing.

According to an embodiment of the present disclosure, the cold drawing of the cooled steel wire may be performed by cold drawing with a reduction rate of 10 to 20%.

When the reduction is less than 10%, lattice defects cannot be sufficiently formed inside the steel wire by cold drawing, and thus they cannot be applied as additional nuclei for formation of graphite grains. When the reduction is greater than 20%, wire breakage may occur during drawing. Therefore, it is preferable that the cold drawing of the present disclosure is performed with a reduction rate of 10 to 20%.

Graphitization Heat Treatment

In the present disclosure, graphitization heat treatment may be performed after the cold drawing. Via the graphitization heat treatment, carbon contained in steel may be graphitized to form a graphite steel.

According to an embodiment of the present disclosure, the graphitization heat treatment may be performed in a temperature range of 740 to 780° C. within 2 hours. The temperature range corresponds to a temperature range around a graphite generation nose in a time-temperature-transformation (TTT) curve and corresponds to a temperature range in which the heat treatment time is the shortest.

When the graphitization heat treatment temperature is lower than 740° C., the graphitization heat treatment time increases. When the graphitization heat treatment temperature exceeds 780° C., the graphitization heat treatment time increases, austenite is produced due to reverse transformation of pearlite, and pearlite may be produced again during cooling. Thus, it is preferable to control the graphitization heat treatment temperature range from 740 to 780° C. in the present disclosure.

By the above-described graphitization heat treatment, a graphite steel having a graphitization rate of 100% may be manufactured. In this regard, the graphitization rate refers to a ratio of the content of carbon present in the graphite state to the content of carbon added to a steel, as defined in Equation (2) below.

$$\text{Graphitization rate (\%)} = (1 - \text{C content in undecomposed pearlite/C content in steel}) \times 100 \quad (2)$$

The graphitization rate of 100% indicates that all added carbon is consumed to produce graphite and thus there is no undecomposed pearlite, in other words, a microstructure in which graphite grains are distributed in a ferrite base material is formed. In this regard, the amount of solid-solution carbon in ferrite and solid-solution carbon dissolved in fine carbides is extremely small and thus it is not considered.

Hereinafter, a graphite steel according to an embodiment of the present disclosure will be described.

A graphite steel according to an embodiment includes, in percent by weight (wt %), 0.6 to 0.9% of carbon (C), 2.0 to 2.5% of silicon (Si), 0.1 to 0.6% of manganese (Mn), 0.015% or less of phosphorus (P), 0.03% or less of sulfur (S), 0.01 to 0.05% of aluminum (Al), 0.01 to 0.02% of titanium (Ti), 0.0005 to 0.002% of boron (B), 0.003 to 0.015% of nitrogen (N), 0.005% or less of oxygen (O), and the remainder of iron (Fe) and inevitable impurities, and satisfying Equation (1), wherein graphite grains are distributed in a ferrite base as a microstructure and a graphitization rate is 100%.

An average grain size of the graphite grains distributed in the ferrite base material of the graphite steel may be 10 μm or less. In this regard, the average grain size refers to an equivalent circular diameter (ECD) of particles detected by observing a cross-section of the graphite steel. Because a smaller average grain size is advantageous for surface roughness during cutting, a lower limit thereof is not particularly limited.

In addition, an aspect ratio (long/short) of the graphite grains may be 2.0 or less. When the aspect ratio of the graphite grains exceeds 2.0, anisotropy occurs in the microstructure to not only deteriorate mechanical properties such as impact toughness but also adversely affect surface roughness during cutting.

In addition, the graphite grains may be distributed in an area fraction of 2.0% or more at a density of 1000 grains/$mm^2$. Because higher area fraction and density of the graphite grains improve machinability, lower limits thereof are not particularly limited.

In addition, a hardness of the graphite steel according to an embodiment of the present disclosure may be from 70 to 85 HRB.

When the fine graphite grains are uniformly distributed in the graphite steel as described above, the formed graphite grains may decrease cutting friction and act as crack initiation sites, thereby significantly improving machinability.

Hereinafter, the present disclosure will be described in more detail through examples. However, it is necessary to note that the following examples are only intended to illustrate the present disclosure in more detail and are not intended to limit the scope of the present disclosure. This is because the scope of the present disclosure is determined by matters described in the claims and able to be reasonably inferred therefrom.

Examples

Billets including components listed in Table 1 below (cross-section: 160 mm□160 mm) were maintained under reheating temperature conditions for 90 minutes and hot-rolled at a high speed to prepare steel wires for graphitization heat treatment having a diameter of 27 mm. Reheating temperature, steel wire rolling temperature, coiling temperature, and cooling rates to 600° C. thereof are shown in Table 2. Also, the number of TiN corresponding to a size of 100 nm or less, area fraction of pearlite, tensile strength, rollability of the prepared steel wires for graphitization heat treatment are shown in Table 2.

After cold drawing each of the prepared steel wires for graphitization heat treatment, the steel wire was subjected to graphitization heat treatment to prepare a graphite steel. Cold drawing reduction rates thereof are shown in Table 3, and graphitization heat treatment was performed at 760° C. for 2 hours in all examples and comparative examples. In addition, graphitization completion, average sizes of graphite grains, aspect ratios (long/short), area fractions of graphite grains, densities of graphite grains, and hardness of the prepared graphite steels are shown in Table 3.

In Tables 1 to 3, inventive steels correspond to steel types satisfying the alloy composition ranges and Equation (1) according to the present disclosure and comparative steels correspond to comparative steel types not satisfying the alloy composition ranges or Equation (1).

Examples 1 to 4 correspond to steel wires for graphitization heat treatment and graphite steels of the present disclosure, and Comparative Examples 1 to 12 correspond to steel wires for graphitization heat treatment and graphite steels prepared using Comparative Steels 1 to 12. Comparative Examples 13 to 17 correspond to steel wires for graphitization heat treatment and graphite steels prepared using the steel type of Inventive Steel 1 but under different conditions for manufacturing steel wires for graphitization heat treatment from those of the present disclosure. Comparative Example 18 to 19 correspond to steel wires for graphitization heat treatment and graphite steels prepared using the steel type of Inventive Steel 1 under the same conditions for manufacturing steel wires for graphitization heat treatment but with different cold drawing reduction rates from those of the present disclosure.

TABLE 1

| Item | | C | Si | Mn | P | S | Al | Ti | B | N | O | Equation (1) |
|---|---|---|---|---|---|---|---|---|---|---|---|---|
| Inventive steel | 1 | 0.7 | 2.35 | 0.27 | 0.0138 | 0.0052 | 0.043 | 0.0150 | 0.0005 | 0.0050 | 0.0030 | 0.0000 |
| | 2 | 0.75 | 2.38 | 0.30 | 0.0101 | 0.0030 | 0.030 | 0.0198 | 0.0019 | 0.0110 | 0.0045 | 0.0028 |
| | 3 | 0.63 | 2.45 | 0.41 | 0.0085 | 0.0042 | 0.023 | 0.0132 | 0.0019 | 0.0040 | 0.0028 | −0.0023 |
| | 4 | 0.86 | 2.46 | 0.13 | 0.0080 | 0.0048 | 0.026 | 0.0190 | 0.0013 | 0.0050 | 0.0029 | −0.0022 |
| Comparative steel | 1 | 1.02 | 2.30 | 0.30 | 0.0121 | 0.0050 | 0.030 | 0.0120 | 0.0013 | 0.0050 | 0.0036 | −0.0002 |
| | 2 | 0.32 | 2.43 | 0.55 | 0.0125 | 0.0050 | 0.032 | 0.0123 | 0.0013 | 0.0050 | 0.0045 | −0.0003 |
| | 3 | 0.61 | 1.00 | 0.30 | 0.0102 | 0.0050 | 0.030 | 0.0122 | 0.0013 | 0.0050 | 0.0047 | −0.0002 |
| | 4 | 0.83 | 2.91 | 0.20 | 0.0082 | 0.0064 | 0.026 | 0.0128 | 0.0013 | 0.0034 | 0.0036 | −0.0020 |
| | 5 | 0.87 | 2.32 | 0.82 | 0.0082 | 0.0064 | 0.023 | 0.0125 | 0.0013 | 0.0032 | 0.0025 | −0.0021 |
| | 6 | 0.72 | 2.22 | 0.05 | 0.0082 | 0.0190 | 0.026 | 0.0120 | 0.0013 | 0.0028 | 0.0030 | −0.0024 |
| | 7 | 0.81 | 2.27 | 0.57 | 0.0074 | 0.0064 | 0.023 | 0.0022 | 0.0013 | 0.0052 | 0.0034 | 0.0029 |
| | 8 | 0.82 | 2.41 | 0.39 | 0.0080 | 0.0280 | 0.045 | 0.0231 | 0.0013 | 0.0100 | 0.0045 | 0.0016 |
| | 9 | 0.65 | 2.45 | 0.39 | 0.0080 | 0.0254 | 0.039 | 0.0198 | 0.0019 | 0.0031 | 0.0025 | −0.0051 |
| | 10 | 0.87 | 2.35 | 0.23 | 0.0087 | 0.0050 | 0.040 | 0.0110 | 0.0006 | 0.0148 | 0.0034 | 0.0108 |
| | 11 | 0.75 | 2.25 | 0.26 | 0.0086 | 0.0024 | 0.032 | 0.0130 | 0.0040 | 0.0100 | 0.0045 | 0.0010 |
| | 12 | 0.07 | 2.32 | 0.28 | 0.0098 | 0.0054 | 0.034 | 0.0120 | 0.0017 | 0.0221 | 0.0047 | 0.0164 |

Equation (1): [N] − [Ti]/3.43 − [B]/0.77 (Here, [N], [Ti], and [B] are wt %.)

TABLE 2

| Item | Steel type | Reheating temp. (□) | Hot Rolling temp. (□) | Coiling temp. (□) | Cooling rate (□/s) | TiN density (no./mm$^2$) | Area fraction of pearlite (%) | Tensile strength (MPa) | Remarks on steel wire rolling |
|---|---|---|---|---|---|---|---|---|---|
| Example 1 | Inventive Steel 1 | 1100 | 970 | 900 | 0.5 | 37 | 96 | 1035 | — |
| Example 2 | Inventive Steel 2 | 1100 | 970 | 900 | 0.5 | 42 | 98 | 1032 | — |
| Example 3 | Inventive Steel 3 | 1100 | 970 | 900 | 0.5 | 25 | 95 | 1042 | — |
| Example 4 | Inventive Steel 4 | 1100 | 970 | 900 | 0.5 | 21 | 98 | 1032 | — |
| Comparative Example 1 | Comparative Steel 1 | 1100 | 970 | 900 | 0.5 | 34 | 96 | 1128 | — |
| Comparative Example 2 | Comparative Steel 2 | 1100 | 970 | 900 | 0.5 | 14 | 88 | 982 | — |
| Comparative Example 3 | Comparative Steel 3 | 1100 | 970 | 900 | 0.5 | 15 | 97 | 994 | — |
| Comparative Example 4 | Comparative Steel 4 | 1100 | 970 | 900 | 0.5 | 23 | 96 | 1145 | — |
| Comparative Example 5 | Comparative Steel 5 | 1100 | 970 | 900 | 0.5 | 23 | 96 | 1104 | — |
| Comparative Example 6 | Comparative Steel 6 | 1100 | 970 | 970 | 0.5 | 15 | 97 | 1028 | — |
| Comparative Example 7 | Comparative Steel 7 | 1100 | 970 | 900 | 0.5 | 7 | 96 | 1045 | — |
| Comparative Example 8 | Comparative Steel 8 | 1100 | 970 | 900 | 0.5 | 8 | 97 | 1040 | — |
| Comparative Example 9 | Comparative Steel 9 | 1100 | 970 | 900 | 0.5 | 5 | 98 | 1035 | — |
| Comparative Example 10 | Comparative Steel 10 | 1100 | 970 | 900 | 0.5 | 23 | 97 | 1030 | — |
| Comparative Example 11 | Comparative Steel 11 | 1100 | 970 | 900 | 0.5 | 12 | 95 | 1021 | — |
| Comparative Example 12 | Comparative Steel 12 | 1100 | 970 | 900 | 0.5 | 14 | 82 | 1112 | — |
| Comparative Example 13 | Inventive Steel 1 | 1000 | 970 | 900 | 0.5 | 8 | 97 | 1034 | — |
| Comparative Example 14 | Inventive Steel 1 | 1100 | 900 | 900 | 0.5 | 25 | 97 | 1053 | surface defect on steel wire |
| Comparative Example 15 | Inventive Steel 1 | 1100 | 970 | 750 | 0.5 | 27 | 98 | 1023 | poor coiling of steel wire |
| Comparative Example 16 | Inventive Steel 1 | 1100 | 970 | 900 | 0.1 | 28 | 93 | 1002 | — |
| Comparative Example 17 | Inventive Steel 1 | 1100 | 970 | 900 | 8.0 | 32 | 92 | 1160 | — |
| Comparative Example 18 | Inventive Steel 1 | 1100 | 970 | 900 | 0.5 | 37 | 96 | 1035 | — |
| Comparative Example 19 | Inventive Steel 1 | 1100 | 970 | 900 | 0.5 | 37 | 96 | 1035 | — |

TABLE 3

| Item | Steel type | Cold drawing reduction rate (%) | Graphitization completion | Graphite grain size (μm) | Aspect ratio | Area fraction of graphite grains (%) | Graphite grain density (no./mm$^2$) | Hardness (HRB) |
|---|---|---|---|---|---|---|---|---|
| Example 1 | Inventive Steel 1 | 14.3 | Completed | 5 | 1.4 | 2.2 | 1990 | 77 |
| Example 2 | Inventive Steel 2 | 14.3 | Completed | 6 | 1.5 | 2.4 | 2013 | 78 |
| Example 3 | Inventive Steel 3 | 14.3 | Completed | 7 | 1.4 | 2.1 | 1785 | 77 |
| Example 4 | Inventive Steel 4 | 14.3 | Completed | 5 | 1.4 | 2.3 | 2033 | 80 |
| Comparative Example 1 | Comparative Steel 1 | 14.3 | wire breakage during cold drawing | | | | | |
| Comparative Example 2 | Comparative Steel 2 | 14.3 | completed | 4 | 1.6 | 1.3 | 682 | 76 |

TABLE 3-continued

| Item | Steel type | Cold drawing reduction rate (%) | Graphitization completion | Graphite grain size (μm) | Aspect ratio | Area fraction of graphite grains (%) | Graphite grain density (no./mm$^2$) | Hardness (HRB) |
|---|---|---|---|---|---|---|---|---|
| Comparative Example 3 | Comparative Steel 3 | 14.3 | Uncompleted | 6 | 1.6 | 1.5 | 889 | 87 |
| Comparative Example 4 | Comparative Steel 4 | 14.3 | | wire breakage during cold drawing | | | | |
| Comparative Example 5 | Comparative Steel 5 | 14.3 | Uncompleted | 7 | 1.5 | 1.7 | 2041 | 88 |
| Comparative Example 6 | Comparative Steel 6 | 14.3 | | wire breakage during cold drawing | | | | |
| Comparative Example 7 | Comparative Steel 7 | 14.3 | Completed | 12 | 1.7 | 2.3 | 765 | 77 |
| Comparative Example 8 | Comparative Steel 8 | 14.3 | Completed | 11 | 1.6 | 2.4 | 875 | 78 |
| Comparative Example 9 | Comparative Steel 9 | 14.3 | Completed | 12 | 1.6 | 2.6 | 686 | 79 |
| Comparative Example 10 | Comparative Steel 10 | 14.3 | Uncompleted | 6 | 1.4 | 2.6 | 896 | 86 |
| Comparative Example 11 | Comparative Steel 11 | 14.3 | Completed | 11 | 1.3 | 2.1 | 896 | 71 |
| Comparative Example 12 | Comparative Steel 12 | 14.3 | Uncompleted | 12 | 1.4 | 1.3 | 982 | 88 |
| Comparative Example 13 | Inventive Steel 1 | 14.3 | Completed | 15 | 2.1 | 2.1 | 976 | 77 |
| Comparative Example 14 | Inventive Steel 1 | 14.3 | Completed | 4 | 1.5 | 2.3 | 770 | 76 |
| Comparative Example 15 | Inventive Steel 1 | 14.3 | Completed | 5 | 1.4 | 2.3 | 1987 | 77 |
| Comparative Example 16 | Inventive Steel 1 | 14.3 | completed | 11 | 1.5 | 1.7 | 980 | 76 |
| Comparative Example 17 | Inventive Steel 1 | 14.3 | | wire breakage during cold drawing | | | | |
| Comparative Example 18 | Inventive Steel 1 | 21.0 | | wire breakage during cold drawing | | | | |
| Comparative Example 19 | Inventive Steel 1 | 7.3 | uncompleted | 7 | 1.5 | 1.7 | 980 | 87 |

Hereinafter, referring to Tables 1 to 3, the examples and comparative examples are evaluated.

Referring to Tables 1 to 3, as a result of satisfying the alloy composition ranges and Equation (1) according to the present disclosure, it was confirmed that in each of the steel wires for graphitization heat treatment according to Examples 1 to 4, the number of TiN having a size of 100 nm or less was 10 or more per 100 μm$^2$, the area fraction of pearlite was 95% or more, and the tensile strength was 1100 MPa or less. In addition, in each of the graphite steels of Examples 1 to 4, graphite grains were distributed in the ferrite base material as a microstructure, the graphitization rate was 100%, the average grain size of graphite grains was 10 μm or less, the aspect ratio (long/short) of graphite grains was 2.0 or less, the graphite grains were distributed in an area fraction of 2.0% or more, the graphite grains were distributed at a density of 1000 grains/mm$^2$ or more, and the hardness was from 70 to 85 HRB.

On the contrary, unlike the above-described Examples 1 to 4, in Comparative Examples 1 to 12 not satisfying the alloy composition ranges or Equation (1), the TiN density, the area fraction of pearlite, or the tensile strength of the steel wire were not satisfied, graphitization was not completed, the average grain size of graphite grains was greater than 10 μm to form coarse grains, the graphite grains were distributed in an area fraction of 2.0% or less, the density of graphite grains was low, or the hardness range was not satisfied.

In Comparative Example 1, the tensile strength of the steel wire exceeded 1100 MPa due to the excessive C content of 1.02 wt %, and thus wire breakage occurred during cold drawing. In Comparative Example 2, the fraction of pearlite was low due to the low C content of 0.32 wt %. Because graphite grains are generated by decomposition of pearlite, a lower fraction of pearlite inevitably leads to a lower fraction of graphite grains. The graphite steel of Comparative Example 2 had a low graphite grain area fraction of 1.3% and a low graphite grain density of 682 grains/mm$^2$.

In Comparative Example 3, graphitization could not be completed within 2 hours since silicon could not sufficiently promote graphitization due to the low Si content of 1.00 wt %. Thus, the graphite grain area fraction and the graphite grain density were low and the hardness was high. In Comparative Example 4, the tensile strength of the steel wire exceeded 1100 MPa due to the excessive Si content of 2.91 wt %, and thus wire breakage occurred during cold drawing.

In Comparative Example 5, graphitization could not be completed within 2 hours since manganese inhibited graphitization due to the excessive Mn content of 0.82 wt %. Also, the tensile strength of the steel wire exceeded 1100 MPa due to the excessive Mn content and the hardness was high. In Comparative Example 6, wire breakage occurred during cold drawing due to the low Mn content of 0.05 wt %.

In Comparative Example 7, the low TiN density (grains/100 mm$^2$) failed to sufficiently act as nuclei for formation of fine and uniform graphite grains due to the low Ti content of 0.0022 wt %. Thus, coarse graphite grains were formed and the density of the graphite grains was low. In Comparative Example 8, coarse TiN grains were formed due to the excessive Ti content of 0.0231 wt % and the low TiN density and thus could not sufficiently act as nuclei for formation of fine and uniform graphite grains. Thus, coarse graphite grains were formed and the density of the graphite grains was low.

In Comparative Example 9, the value of Equation (1) was less than −0.003, and thus coarse TiN or BN was formed by Ti or B excessively remaining in the steel thereby failing to acting as nuclei suitable for formation of graphite grains. Thus, coarse graphite grains were formed and the density of the graphite grains was low. In Comparative Example 10, the value of Equation (1) was greater than 0.003, and thus graphitization was delayed due to the high content of solid-solution nitrogen in the steel. Thus, graphitization could not be completed within 2 hours.

In Comparative Example 11, Equation (1) was not satisfied due to the excessive B content of 0.004 wt %. Thus, coarse graphite grains were formed and the density of the graphite grains was low.

In Comparative Example 12, Equation (1) was not satisfied due to the excessive N content of 0.0221 wt % and the tensile strength of the steel wire increased due to the excessive content of solid-solution nitrogen. Because the solid-solution nitrogen delayed graphitization, graphitization was not completed within 2 hours, and thus the hardness range was not satisfied.

In Comparative Example 13, coarse TiN or BN was formed due to the low reheating temperature of 1000° C. and could not act as suitable nuclei for formation of graphite grains. Thus, coarse graphite grains were formed and the density of the graphite grains was low.

In Comparative Example 14, surface defects were formed during hot rolling due to the low hot rolling temperature of 900° C.

In Comparative Example 15, a poor shape of the coiled steel wire was obtained due to the low coiling temperature of 750° C.

In Comparative Example 16, the proeutectoid phase was excessively formed due to the low cooling rate of 0.1° C./s, and thus the area fraction of pearlite was not satisfied. Thus, the density of graphite grains formed after graphitization heat treatment was low. In Comparative Example 17, wire breakage occurred during cold drawing due to a hard structure produced from supercooled austenite due to the high cooling rate of 8.0° C./s.

In Comparative Example 18, wire breakage occurred since the reduction rate of the cold drawing exceeded 20%, and in Comparative Example 19, lattice defects were not sufficiently generated due to the low reduction rate less than 10%, and thus graphitization could not be completed within 2 hours. Thus, the density of graphite grains formed after graphitization heat treatment was low.

In addition, based on the above-described results, it was confirmed that the graphitization heat treatment time may be significantly reduced according to the present disclosure by promoting graphitization using the alloy composition for promoting graphitization and utilizing TiN acting as nuclei for forming graphite grains, and further promoting graphitization by inducing lattice defects via cold drawing with an appropriate reduction rate.

In addition, it was confirmed that the graphite steel in which fine graphite grains are uniformly distributed in a base material after graphitization may be provided according to the present disclosure.

While the present disclosure has been particularly described with reference to exemplary embodiments, it should be understood by those of skilled in the art that various changes in form and details may be made without departing from the spirit and scope of the present disclosure.

The invention claimed is:

1. A steel wire for graphitization heat treatment comprising, in percent by weight (wt %), 0.6 to 0.9% of carbon (C), 2.0 to 2.5% of silicon (Si), 0.1 to 0.6% of manganese (Mn), 0.015% or less of phosphorus (P), 0.03% or less of sulfur(S), 0.01 to 0.05% of aluminum (Al), 0.01 to 0.02% of titanium (Ti), 0.0005 to 0.002% of boron (B), 0.003 to 0.015% of nitrogen (N), 0.005% or less of oxygen (O), and the remainder of iron (Fe) and inevitable impurities, and satisfying Equation (1) below:

$$-0.003<[N]-[Ti]/3.43-[B]/0.77<0.003$$

wherein in Equation (1), [Ti], [N], and [B] are wt % of titanium, nitrogen, and boron, respectively, wherein a number of TiN having a size of 100 nm or less is 10 or more per 100 $\mu m^2$, wherein a tensile strength is 1100 MPa or less.

2. The steel wire of claim 1, wherein an area fraction of pearlite is 95% or more.

3. A method of manufacturing the steel wire of claim 1, the method comprising:

preparing a billet comprising, in percent by weight (wt %), 0.6 to 0.9% of carbon (C), 2.0 to 2.5% of silicon (Si), 0.1 to 0.6% of manganese (Mn), 0.015% or less of phosphorus (P), 0.03% or less of sulfur(S), 0.01 to 0.05% of aluminum (Al), 0.01 to 0.02% of titanium (Ti), 0.0005 to 0.002% of boron (B), 0.003 to 0.015% of nitrogen (N), 0.005% or less of oxygen (O), and the remainder of iron (Fe) and inevitable impurities, and satisfying Equation (1) below;

reheating the billet;

hot rolling the reheated billet into a steel wire;

coiling the steel wire; and cooling the coiled steel wire:

$$-0.003<[N]-[Ti]/3.43-[B]/0.77<0.003$$

wherein in Equation (1), [Ti], [N], and [B] are wt % of titanium, nitrogen, and boron, respectively.

4. The method of claim 3, wherein the reheating comprises heat-treating the billet in a temperature range of 1050 to 1150° C. for 60 minutes or more.

5. The method of claim 3, wherein the hot rolling of the reheated billet into a steel wire comprises hot rolling the reheated billet in a temperature range of 900° C. to 1000° C.

6. The method of claim 3, wherein the coiling comprises coiling the steel wire in a temperature range over 800° C.

7. The method of claim 3, wherein the cooling comprises cooling the coiled steel wire to 600° C. at a cooling rate of 0.2 to 5.0° C./s.

* * * * *